US007458259B2

(12) United States Patent
Hainey

(10) Patent No.: US 7,458,259 B2
(45) Date of Patent: Dec. 2, 2008

(54) SHOCK TUBE TIP TESTER

(75) Inventor: Herbert W. Hainey, Arlington, WA (US)

(73) Assignee: Rothenbuhler Engineering Company, Sedro-Woolley, WA (US)

( * ) Notice: Subject to any disclaimer, the term of this patent is extended or adjusted under 35 U.S.C. 154(b) by 445 days.

(21) Appl. No.: 11/235,783

(22) Filed: Sep. 27, 2005

(65) Prior Publication Data

US 2007/0234920 A1 Oct. 11, 2007

Related U.S. Application Data

(60) Provisional application No. 60/613,601, filed on Sep. 27, 2004.

(51) Int. Cl.
*G01L 1/16* (2006.01)

(52) U.S. Cl. ..... 73/167; 73/862.51; 73/862.53

(58) Field of Classification Search ..... 73/167, 73/862.51, 862.53; 42/1.01
See application file for complete search history.

(56) References Cited

U.S. PATENT DOCUMENTS 3,260,107 A * 7/1966 Rosen ..... 73/167
4,274,282 A * 6/1981 Budraitis et al. ..... 73/862.625
4,489,617 A * 12/1984 Smith ..... 73/862.191
5,052,817 A * 10/1991 Bement et al. ..... 374/8

* cited by examiner

*Primary Examiner*—Stephen M Johnson
(74) *Attorney, Agent, or Firm*—Christensen O'Connor Johnson Kindness PLLC

(57) ABSTRACT

A shock tube tip tester determines reliability of a shock tube tip used in a blasting machine. The blasting machine, using shock tubes for non-electric firing, relies on a shock tube tip to initiate the blast. The shock tube tip tester measures the amount of wear and indicates when a particular shock tube tip should be replaced to help prevent misfires or delays in production due to no-fires. The shock tube tip tester includes a mechanical filter suitable for filtering the shock wave pulse created by the shock tube tip, a pressure sensor for sensing the filtered shock wave pulse, and a microprocessor for classifying the shock tube tip into one of several predefined conditions based on either a peak of the shock wave pulse or an area under the shock wave pulse.

8 Claims, 20 Drawing Sheets

SHOCK TUBE TIP TESTER

CROSS-REFERENCE TO RELATED APPLICATION

This application claims the benefit of U.S. provisional application No. 60/613,601, filed on Sep. 27, 2004, which is expressly incorporated herein by reference.

FIELD OF THE INVENTION

The present invention relates generally to reliability testing, and more particularly to testing shock tube tips for creating a shock wave to detonate explosives.

BACKGROUND OF THE INVENTION

In the mining industry or explosive industry, the use of shock tubes has grown in popularity to supplant electric wires and electric blasting caps. A shock tube (e.g., shock tubing, a shock fuse, impulse propagating tubing, signal transmission line, or the like) is a plastic capillary tube with inner surface which is coated with a reactive substance, such as a thin layer of a detonating or deflagrating explosive composition. Initiating the shock tube is often accomplished by a shock tube tip (a firing pin, a firing tip, or the like) for creating a shock wave that initiates the explosive lining of the shock tube. However, the shock tube tip wears out after repeated use to initiate blasts. The life of the shock tube tip typically wears out after about 200-500 shocks. Thus, at some point, the shock tube tip may become worn enough so as to no longer reliably initiate a blast. A failure of the shock tube tip may lead to misfires, delay in production due to no-fires or misfires, a safety hazard, and possibly create many complications with attendant high-cost associated with a failure. Accordingly, it would be desirable to provide a way to test the operating condition of the shock tube tip in advance of initiating a blast.

SUMMARY OF THE INVENTION

In accordance with this invention, a remote firing system, a tester, and a method for testing reliability of shock tube tips are provided. The system form of the invention includes a remote firing system that comprises a remote device capable of utilizing a shock tube to initiate a detonation. The system further comprises a testing system for determining an operating condition of a shock tube tip for producing a shock wave pulse with sufficient intensity to initiate a blast. The shock tube tip coupled to the remote device may be inserted into the testing system via a test shock tube which does not include explosive linings. The system further comprises a controller for sending arming and firing signals to the remote device. In response to the arming and firing signals, the shock tube tip is fired and produces a spark that creates a shock wave pulse along the test shock tube. The tester may measure an intensity of the shock wave pulse in order to determine the condition of the shock tube tip.

In accordance with further aspects of this invention, a device form of the invention includes a tester that includes a mechanical filter suitable for smoothing, averaging, filtering and/or delaying the shock wave pulse produced by firing a shock tube tip. The tester further includes a pressure sensor for sensing the filtered shock wave pulse; an analog-to-digital converter for converting the sensed shock wave pulse into a digitized shock wave pulse; and a microprocessor for detecting the existence of the digitized shock wave pulse and determining the condition of the shock tube tip based on either a peak of the digitized shock wave pulse or an area under the digitized shock wave pulse. When the area under the shock wave pulse is used to indicate the condition of the shock tube tip, the tester further includes an integrator coupled to an analog-to-digital converter (ADC). The integrator determines the area of the digitized shock wave pulse. Either the peak of the digitized shock wave pulse or the area under the digitized shock wave is used to classify the shock tube tip into one of the several predefined conditions. The tester further includes a corresponding indicator for indicating each condition of the shock tube tip.

In accordance with further aspects of this invention, a method form of the invention includes a method for testing reliability of a shock tube tip in a remote firing system. The method includes firing the shock tube tip into a test shock tube by a blasting device. The method further includes filtering a shock wave pulse by a mechanical filter, the shock wave pulse being created when the shock tube tip is fired. The method yet further includes sensing the filtered shock wave pulse by a pressure sensor coupled to an analog-to-digital converter. The method further includes converting the sensed shock wave to digital information by the analog-to-digital converter. The method yet further includes detecting an existence of the shock wave pulse based on the digital information. Upon detection of the existence of the shock wave, the method further includes determining a condition of the shock tube tip. The condition of the shock tube tip is a reliable condition if either a peak of the shock wave pulse or an area of the shock wave pulse is above a reliable threshold; an unreliable condition if either the peak of the shock wave pulse or the area of the shock wave pulse is below an unreliable threshold; and a marginal condition if either the peak of the shock wave pulse or the area of the shock wave pulse is above an unreliable threshold and below a reliable threshold. The method further includes activating a corresponding indicator of the determined condition.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

As discussed hereinbefore, a shock tube tip tester determines reliability of a shock tube tip used in a remote firing system. A typical remote firing system using shock tubes for non-electric firing relies on a special spark-producing shock tube tip to initiate the blast. The shock tube tip wears out after repeated use to initiate blasts.

Figure 1:
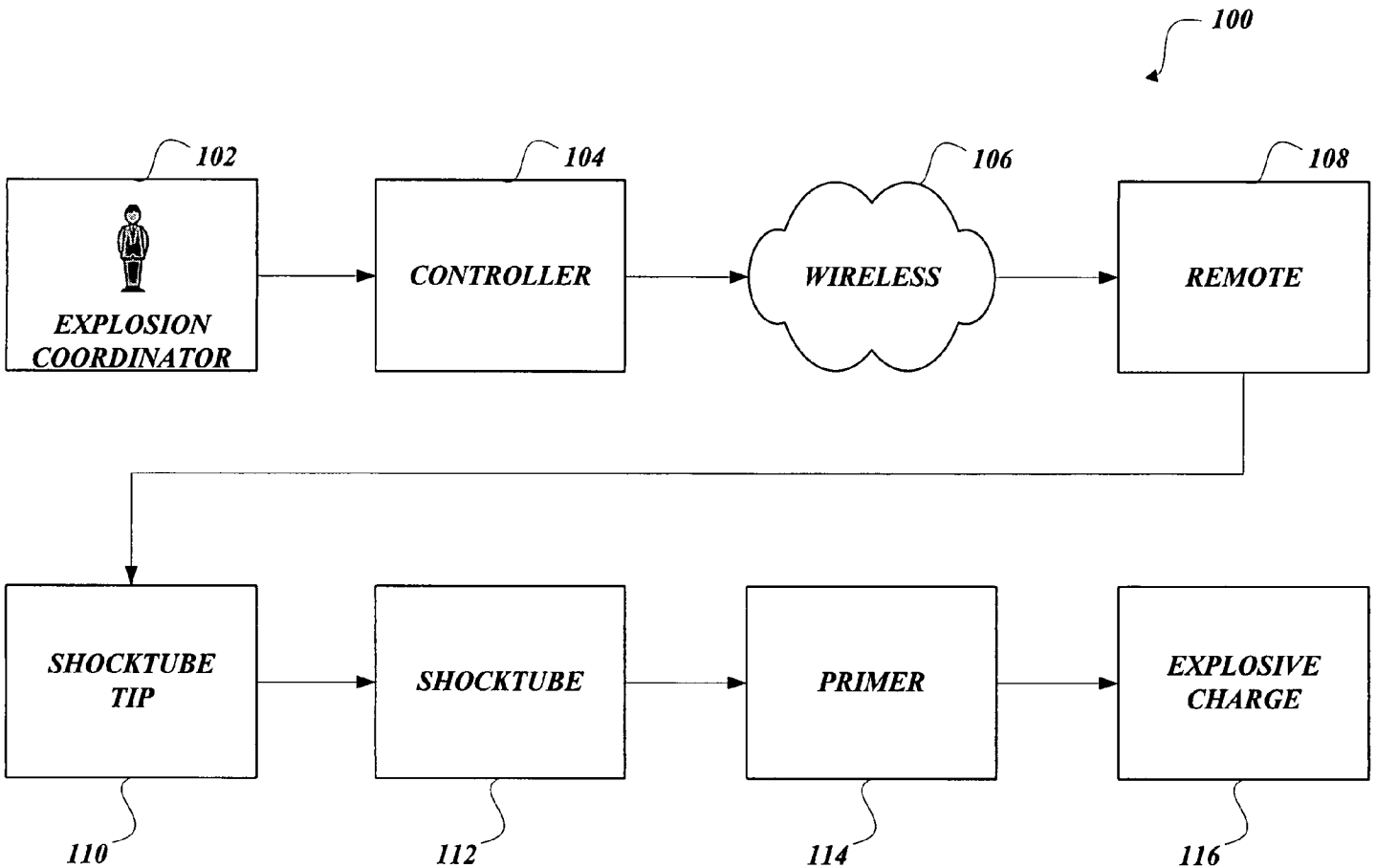
FIG. 1 is a block diagram illustrating an exemplary remote firing system, wherein a remote utilizes a shock tube to initiate detonation.

FIG. 1 illustrates an exemplary remote firing system 100 using a shock tube tip. The remote firing system 100 includes a controller 104 for transmitting, arming, and firing signals or commands to a remote device 108. The remote device 108 is usually communicatively coupled to the controller 104 via a wireless communication line 106, or the like. In one embodiment of the present invention, the remote device 108 may be communicatively coupled to the controller 104 via a wireless network 106. The remote device includes a shock tube tip 110 which is connected to a shock tube 112.

The shock tube 112 is a plastic capillary tube lined with an explosive compound. The shock tube tip 110 produces a high-energy spark creating a shock wave that initiates the explosive lining of the shock tube 112. As the lining rapidly burns, it produces an even greater shock wave that quickly propagates down to the terminal end of the shock tube where a primer 114 and explosive charge 116 are attached. The produced shock wave initiates the primer 114 and then initiates the actual explosive charge 116.

The shock tube tip 110 is similar in operation to a common spark plug. When a shock tube tip fails to produce a spark, or slowly deteriorates by producing a gradually weaker spark, the shock tube tip is no longer reliable, which is undesirable for a remote firing system. As such, an operator or explosion coordinator 102 needs to know in advance whether the shock tube tip is in good condition or whether it should be replaced, or how soon it should be replaced. The shock tube tip tester measures the amount of wear and indicates when a particular shock tube tip should be replaced to help prevent misfires or delays due to no-fires.

Figure 2:
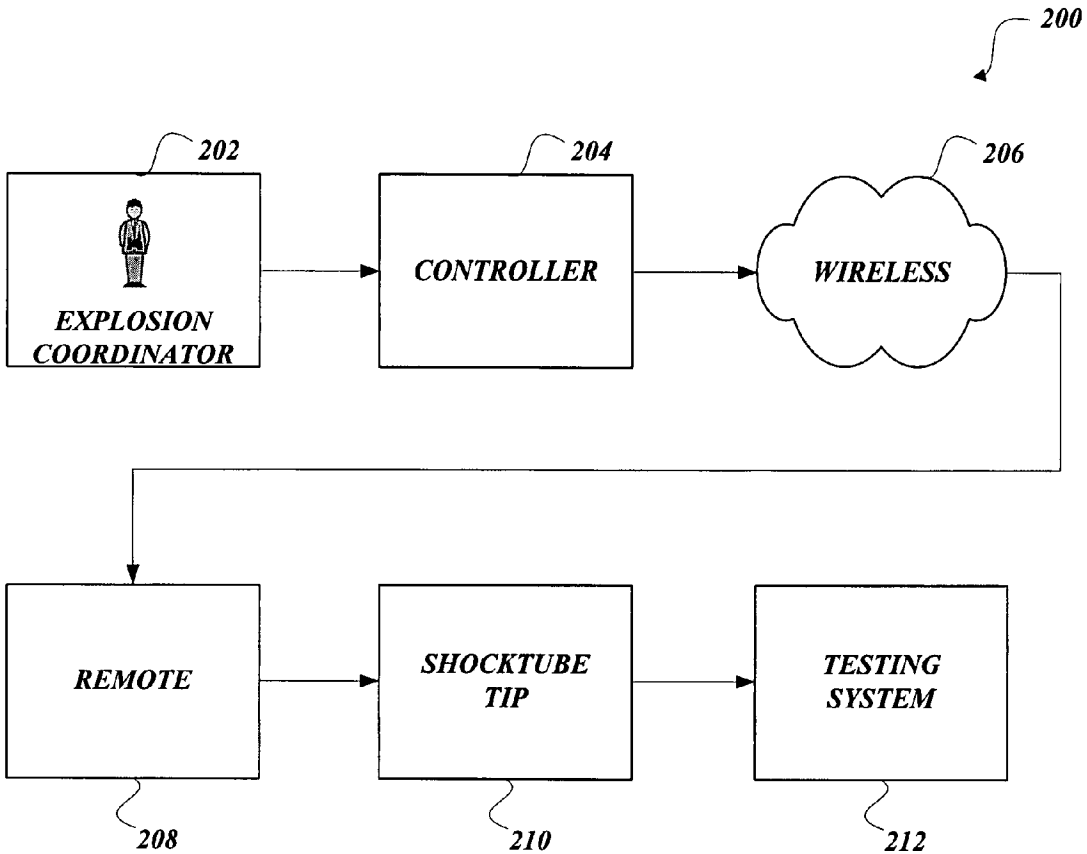
FIG. 2 is a block diagram illustrating a remote firing system using a shock tube tip tester to test reliability of the remote device in accordance with one embodiment of the present invention.

FIG. 2 illustrates the constituent parts of a remote firing system 200 in accordance with an embodiment of the present invention. The remote firing system 200 includes a remote device 208 and a controller 204 that are communicatively connected via a wireless communication line 206 or the like. In one embodiment of the present invention, the remote device 208 may be communicatively coupled to the controller 204 via a wireless network 206. The remote device 208 is capable of using a shock tube for non-electric firing. The remote device 208 includes a shock tube tip 210 that creates a shock wave in response to a firing signal initiated by an explosion coordinator (a user) 202 from the controller 204.

The remote firing system 200 further includes a testing system 212 for reliability testing on the remote device. It is to be understood that the shock tube tip 210 is similar in operation to a common spark plug. In response to a firing signal (firing command), the remote device 208 applies high-voltage pulse to the shock tube tip causing it to arc. The arc produces a shock wave pulse (pressure) whose presence can be detected by sensing the pressure. The intensity of the pressure created by the shock wave pulse may indicate the intensity of the arc that produced the shock. As such, the testing system 212 operates by measuring the intensity of the shock wave pulse to infer the intensity of the spark that the shock tube tip 210 produces.

Figure 3A:
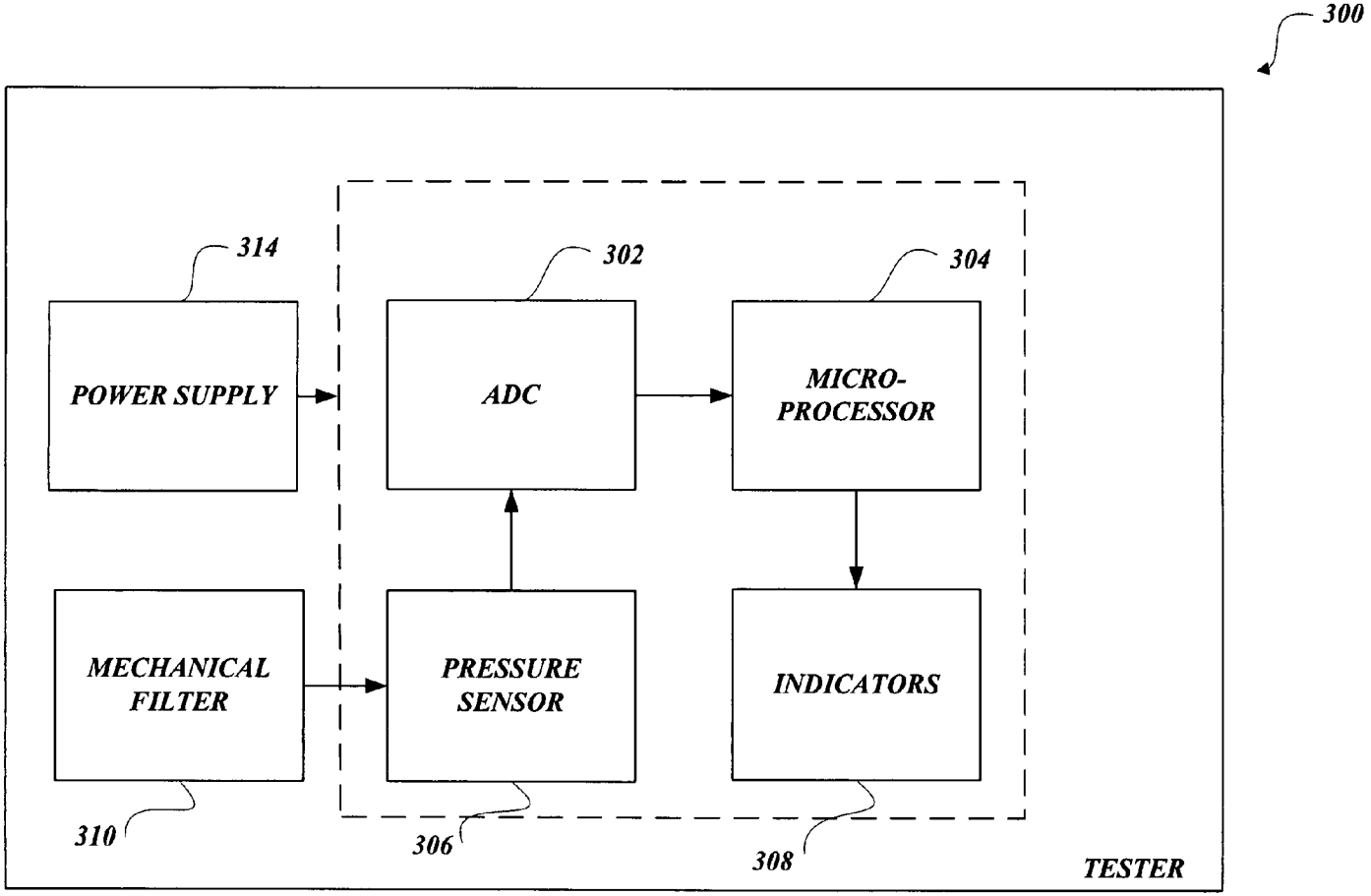
FIGS. 3A-3B are block diagrams depicting internal modules included in the shock tube tip tester in accordance with one embodiment of the present invention.

FIG. 3A illustrates a block diagram showing internal modules of the testing system (tester) 300. The tester 300 includes a mechanical filter 310 coupled to a pressure sensor 306 housed inside the tester 300. Any suitable mechanical filter can be used, such as metal screens, porous plates, fiber materials (e.g., steel wool), and so on. The mechanical filter 310 is configured to filter, smooth, average, and/or delay the shock wave pulse adapted to be received by the pressure sensor 306. Preferably, the mechanical filter 310 delays the shock wave pulse long enough to allow the high-energy electrical noise pulse to dissipate before the shock wave pulse reaches the pressure sensor 306.

The mechanical filter 310 is also connected to a test shock tube (not shown) into which a shock tube tip under test is inserted. The test shock tube does not include explosive linings. In one embodiment of the present invention, the mechanical filter 310 may be an inert shock tube capable of filtering, smoothing, averaging, and/or delaying the shock wave pulse. One suitable length for the inert shock tube includes approximately five to six feet, but other lengths may be used as long as the length is sufficient for an inert shock tube to be used as the mechanical filter 310.

As previously described, the shock tube tip under test is connected to the remote device (not shown) which performs arming and firing signals (i.e., fires the shock tube tip to start a spark at the shock tube tip). When the shock tube tip is fired into the test shock tube, the shock wave pulse is smoothed, averaged, filtered and/or delayed by the mechanical filter 310. The filtered shock wave pulse is sensed by a pressure sensor 308. In one embodiment of the present invention, the shock tube tip tester 300 includes a pressure sensor 306, such as a piezoelectric device, that outputs voltage signals when the shock wave pulse is sensed. Preferably, the output voltage signals have a range between 0.0V to 5.0V. However, other suitable pressure sensors with various degrees of sensitivity may be used, as long as the pressure sensor is capable of sensing the shock wave pulse and presenting appropriate signals to an analog-to-digital converter (ADC) 302.

The shock tube tip tester 300 further includes a microprocessor 304 coupled to the ADC 302. The level of pressure built in the test shock tube when the shock tube tip is fired may correlate with an operating condition of the shock tube tips (i.e., a quality or intensity of the electric spark). Also, the level of pressure built in the test shock tube when the shock tube tip is fired may correlate with the magnitude of the peak or area of the shock wave pulse. Thus, the shock tube tip tester 300 uses either the peak of the shock wave pulse or the area under the shock wave pulse to infer the intensity of the spark produced by the shock tube tip. The voltage output signals (voltage signals) of the sensed shock wave pulse from the pressure sensor 308 are provided to the ADC 302. The voltage signals are converted to digital information whose values range preferably from 0-1023 by the ADC 302. The microprocessor 304 receives the digital information from the ADC 302 and detects the existence of the shock wave pulse. In one embodiment of the present invention, the peak of the shock wave pulse is used to indicate the condition of the shock tube tip. After the microprocessor 304 detects the existence of the shock wave pulse based on the digital information, the microprocessor determines the peak of the shock wave pulse to infer the condition of the shock tube tip.

Preferably, three conditions of the shock tube tip, such as a reliable condition, a marginal condition, and an unreliable condition, may be determined. The magnitude of the peak of the shock wave pulse is compared with various thresholds, such as a reliable threshold and an unreliable threshold. If the magnitude of the peak of the shock wave pulse is over the reliable threshold, the shock tube tip is considered reliable. If the magnitude of the peak of the shock wave pulse is between the reliable threshold and the unreliable threshold, the shock tube tip is considered marginally reliable. In other words, the shock tube tip may be required to be replaced soon. If the magnitude of the peak of the digitized shock wave pulse is below the unreliable threshold, the shock tube tip is considered unreliable and its replacement is recommended.

In one embodiment of the present invention, the reliable threshold may be set to a value of 700 (the ADC 302 converts the voltage signals ranged 0V-5V to digital information ranged 0 to 1023), and the unreliable threshold may be set to a value of 500. In this embodiment, if the magnitude of the peak of the digitized shock wave pulse is over 700, it is classified as having a reliable condition. If the peak of the digitized shock wave pulse is over 500 but below 700, it is classified as having a marginally reliable condition. If the peak of the digitized shock wave pulse is below 500, it is classified as having an unreliable condition. It is to be noted that other various numbers of conditions of the shock tube tip can be determined depending on the need of the user. In one embodiment of the present invention, the user of the shock tube tip tester may set desired thresholds and predefined conditions.

The shock tube tip tester 300 further includes a power supply 314 capable of allowing the shock tube tip tester to be portable. Examples of the suitable power supply 314 include a battery, a rechargeable battery, and so on. However, other suitable means to power the shock tube tip tester 300 can be used.

Figure 3B:
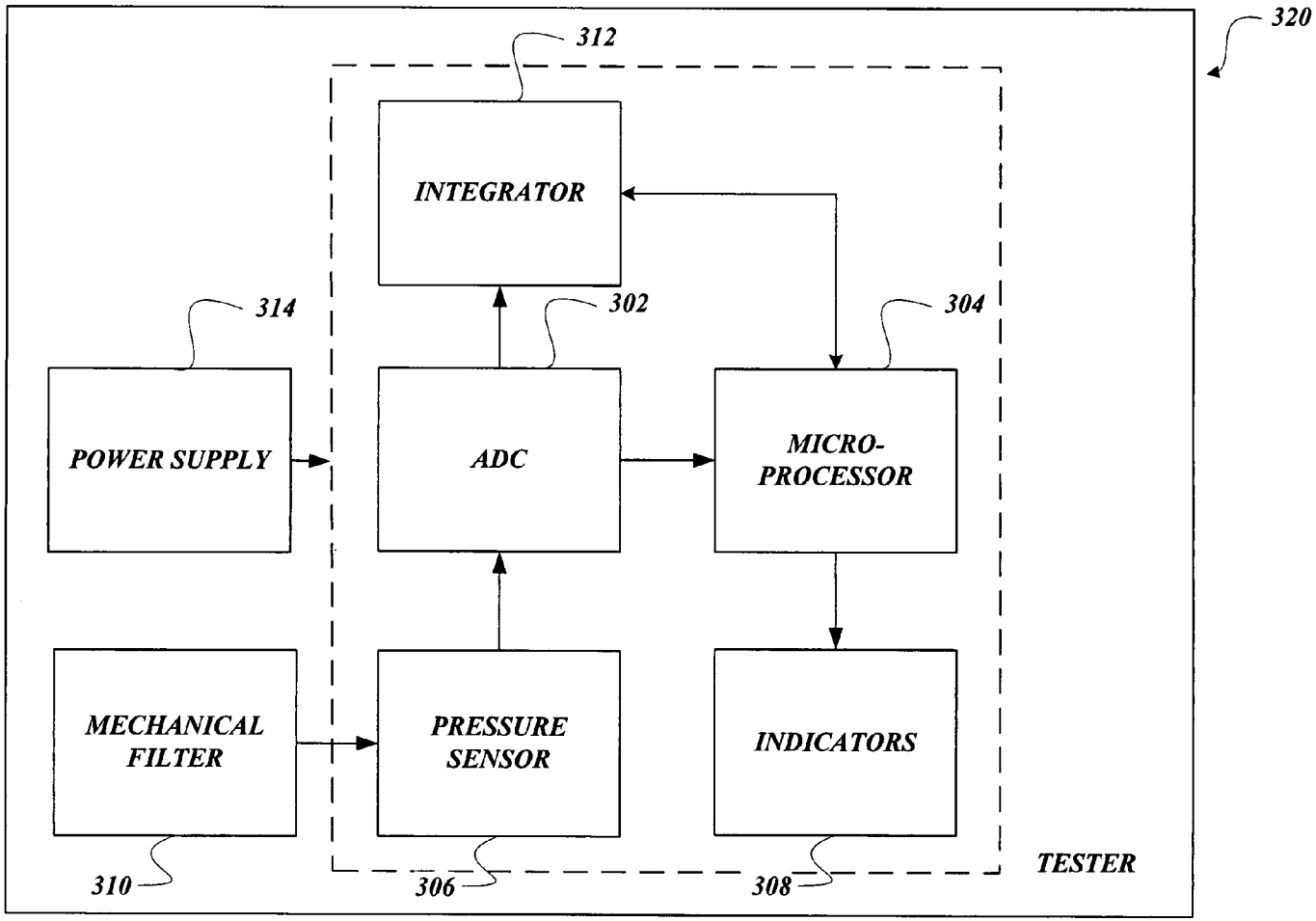

In one embodiment of the present invention, the area under the shock wave pulse is used to indicate the condition of the shock tube tip. FIG. 3B illustrates a block diagram showing internal modules of such a testing system (shock tube tip tester) 320, including an integrator 312 for determining the area under the shock wave pulse. The integrator 312 receives the digital information from the ADC 302. After the microprocessor 304 detects the existence of the shock wave pulse, the integrator 312 provides the area under the shock wave pulse to the microprocessor 304. The microprocessor 304 uses the area under the shock wave pulse to infer the condition of the shock tube tip.

Figure 3C:
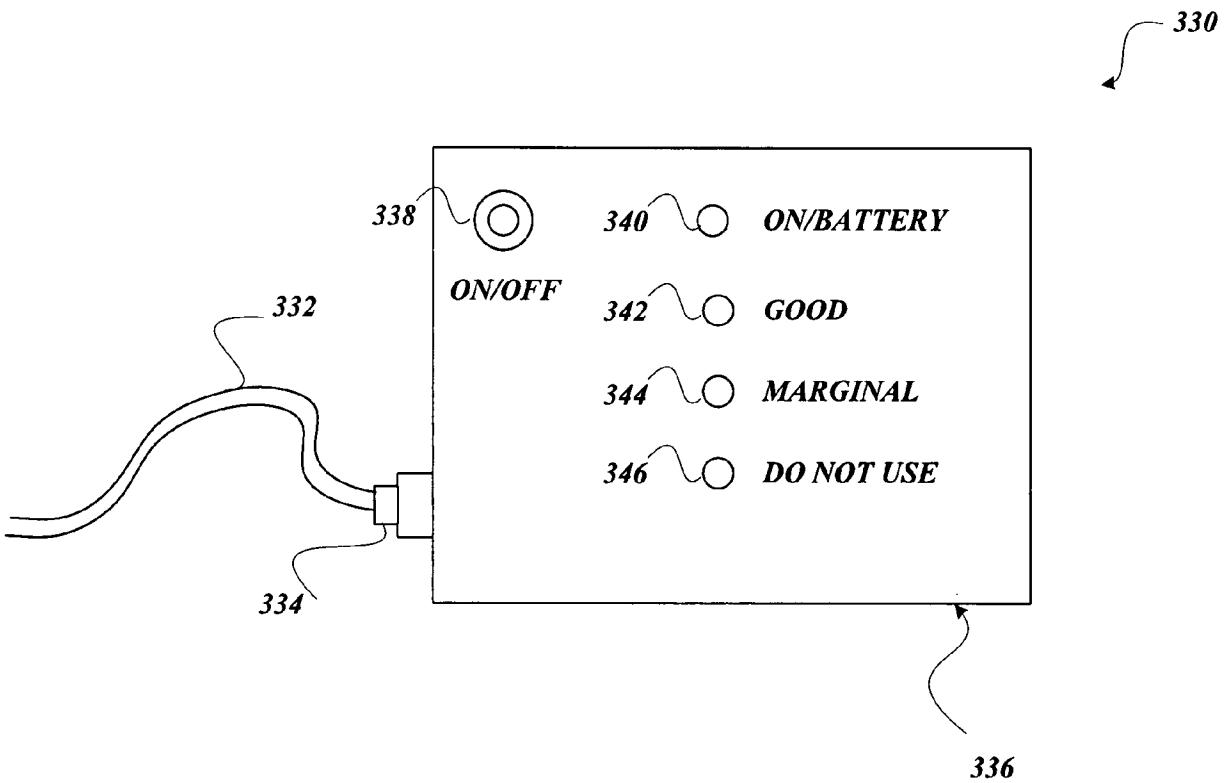
FIG. 3C is a pictorial diagram illustrating a shock tube tip tester user interface in accordance with one embodiment of the present invention.

FIG. 3C illustrates a shock tube tip tester user interface 330, including an indicator panel 336, and an on/off switch 338. The indicator panel 336 may include colored indicators 340-346 used to indicate the condition of the shock tube tip. Examples of the colored indicators include various colored light-emitting diodes (LEDs), and the like. In one embodiment of the present invention, the indicator panel 336 of the shock tube tip tester preferably has a power-on indicator 340, three status indicators 342-346 and the like. The status indicators 342-346 may include green LED ("good") 342, yellow LED ("marginal") 344, and red LED ("do not use") 346. The red LED 346 may be used to indicate that the shock tube tip is not reliable. The green LED 342 may be used to indicate that the shock tube tip is reliable, and the yellow LED 344 may be used to indicate that the shock tube tip is marginally reliable. The on/off switch 338 may be a push-button switch to turn on the shock tube tip tester. However, other suitable switches can be used.

In one embodiment of the present invention, a combination of the status indicators 342-346 may be used to indicate the status of the power supply. For example, during a power-up sequence, the status indicators 342-346 can be used to display the status of the battery power supply by illuminating the red light for a poor battery; red and yellow lights for a marginal battery; and red, yellow, and green lights for a good battery. In one embodiment, the on-battery indicator 340 is used as a power-on indicator. The on-battery indicator is preferably steady in normal operation and blinks when the battery is too low, hence needing to be replaced. Preferably, the test shock tube 332 is held in place by a collet 334. The collet 334 is a collar that rotates with the test shock tube 332 as the test shock tube 332 is twisted back and forth. The collet 334 locks the test shock tube 332 coupled to the mechanical filter (not shown) inside of the shock tube tip tester.

Figure 4:
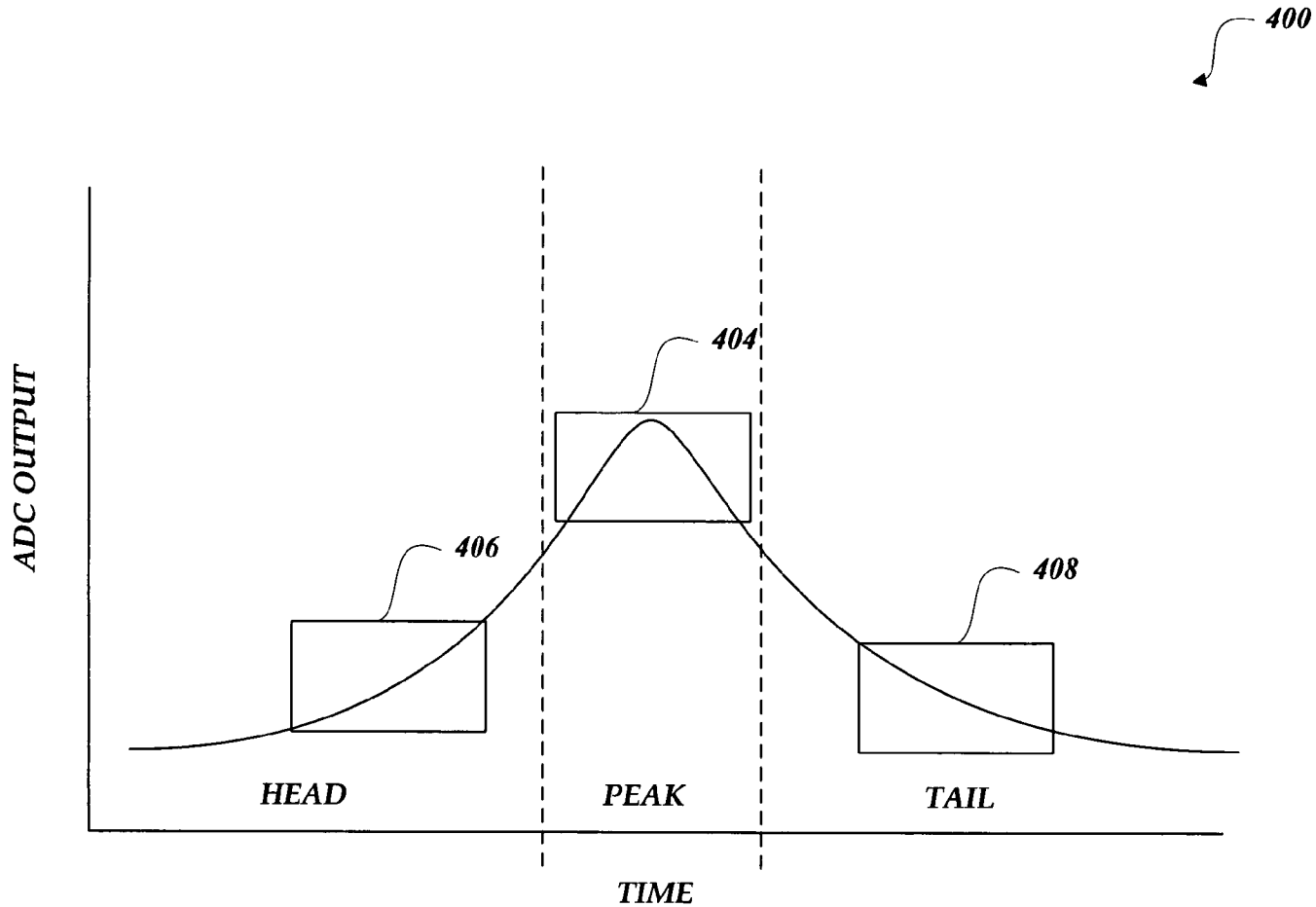
FIG. 4 is a pictorial diagram depicting a graph with superposed windows over a digitized pulse in accordance with one embodiment of the present invention.

FIG. 4 illustrates a graph 400 of digital information (a digitized shock wave pulse) used by the shock tube tip tester to determine the existence of the shock wave pulse. The digitized shock wave pulse may be formed based on the digital information which has been converted from the voltage signals (output of the pressure sensor) by the ADC. Preferably, the digitized shock wave pulse gets a reference level (level 0) based on the voltage signals of the ambient pressure. The voltage signals of the ambient pressure may be determined just before the shock tube tip is fired. In one embodiment of the present invention, the shock tube tip tester superposes windows 404, 406, 408 on the digitized shock wave pulse to detect a head, a peak, or a tail of the digitized shock wave pulse. If the shock tube tip tester detects a positive slope, as shown in window 406, this indicates that the head of the digitized shock wave pulse has been detected. If the shock tube tip tester detects a negative slope and an absence of excessive fluctuation, as shown in window 408, this indicates the tail of the digitized shock wave pulse has been determined. If the shock tube tip tester detects a positive slope and then a negative slope, as shown in window 404, this indicates the peak of the digitized shock wave pulse has been found.

After the shock tube tip tester detects the head, the shock tube tip tester attempts to detect the peak. If the peak is found, the shock tube tip tester attempts to detect the tail. If the shock tube tip tester detects the peak, the head, or the tail alone and not a combination of the three, the shock tube tip tester concludes that the digital information comprising the graph 400 does not constitute a shock wave pulse. When the shock tube tip tester is not able to detect the head or the tail of the digitized shock wave pulse due to a severe fluctuation of the shock wave pulse, the shock tube tip tester also concludes the nonexistence of the shock wave pulse. Other suitable methods to determine the existence of the shock wave pulse may be used by the shock tube tip tester.

Figure 5A:
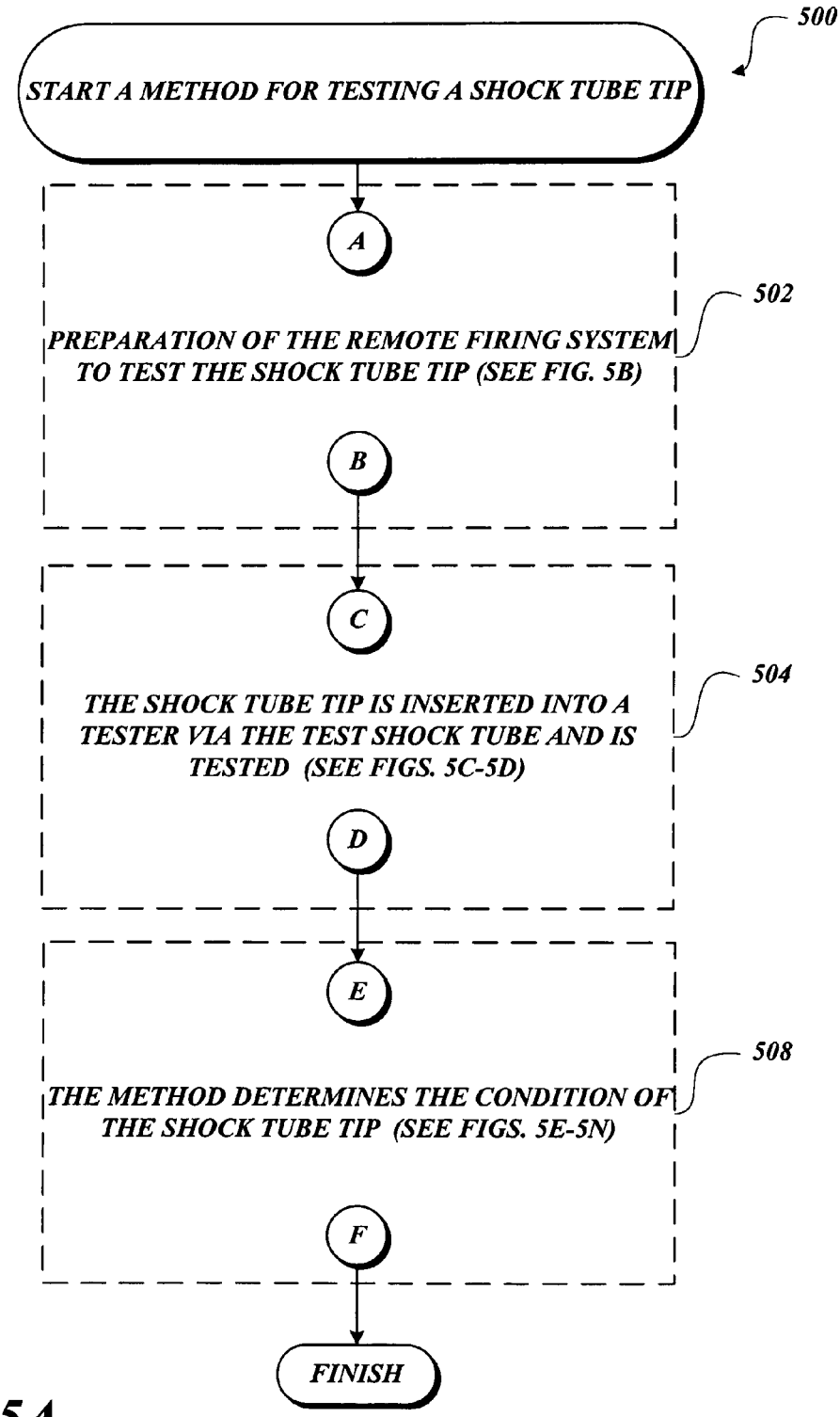
FIGS. 5A-5N are process diagrams illustrating an exemplary method formed in accordance with one embodiment of the present invention.
Figure 5B:
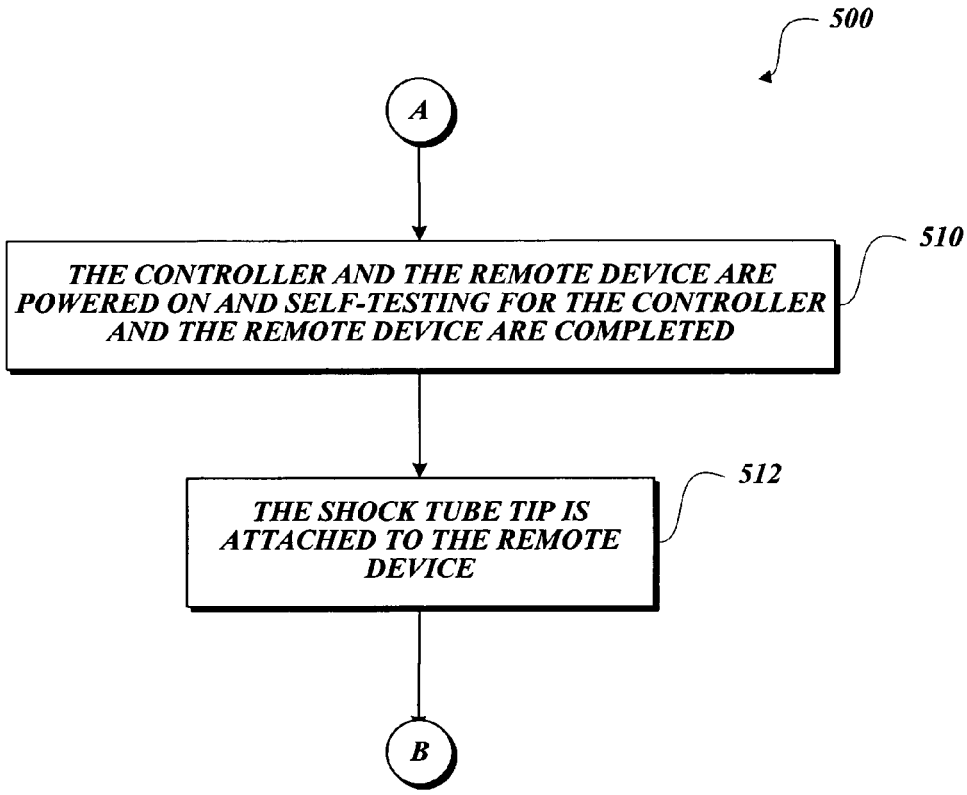
Figure 5C:
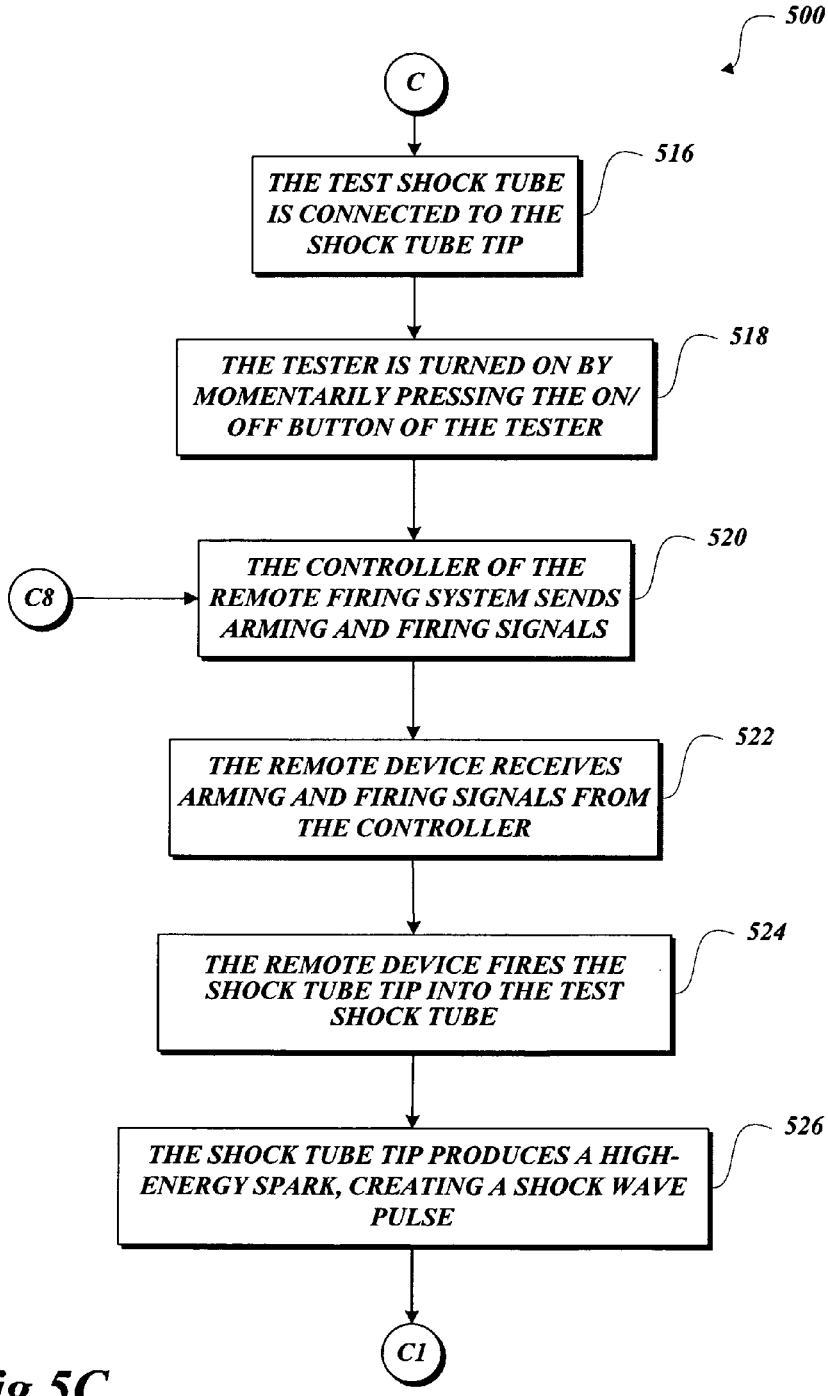
Figure 5D:
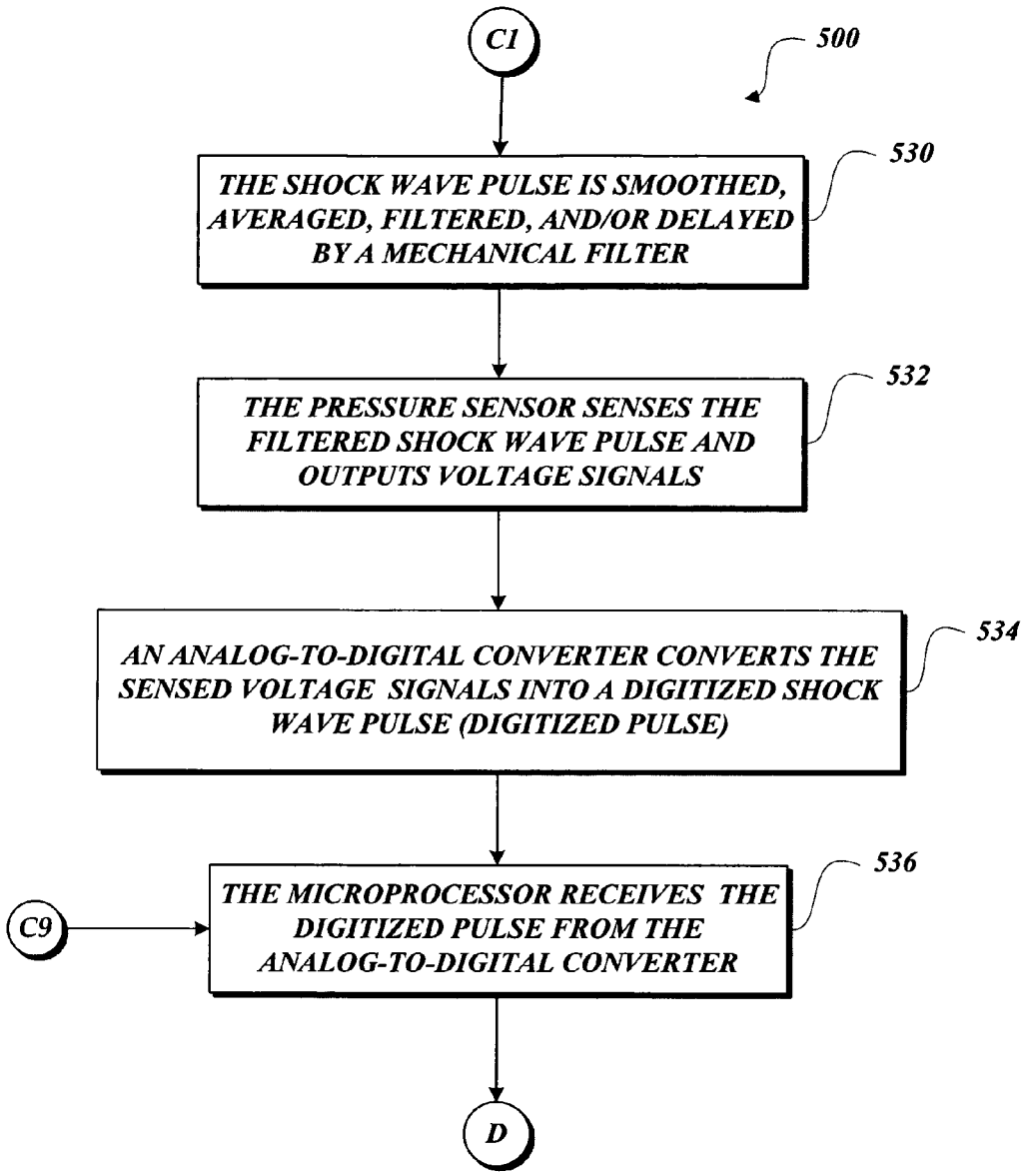
Figure 5E:
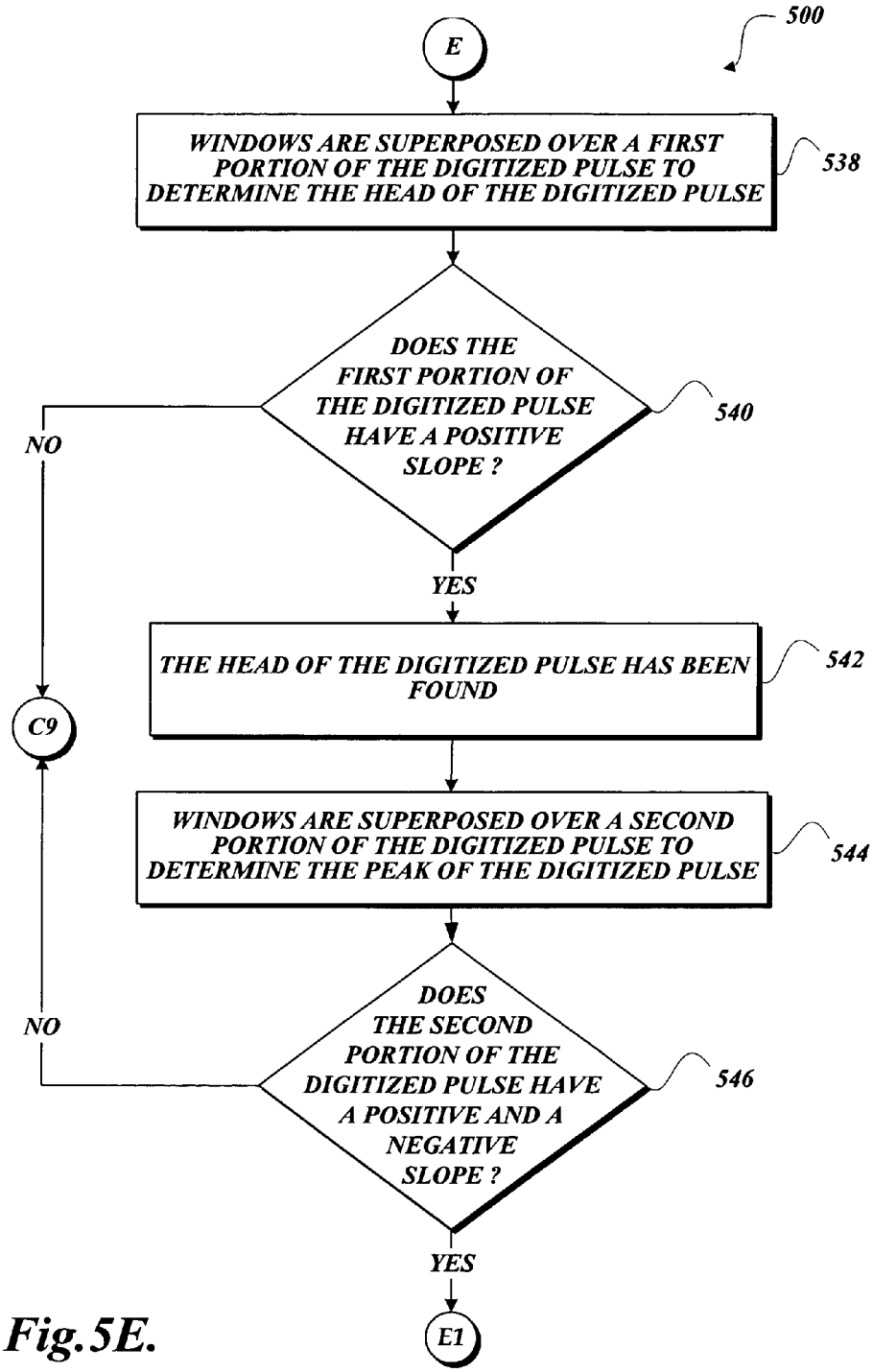
Figure 5F:
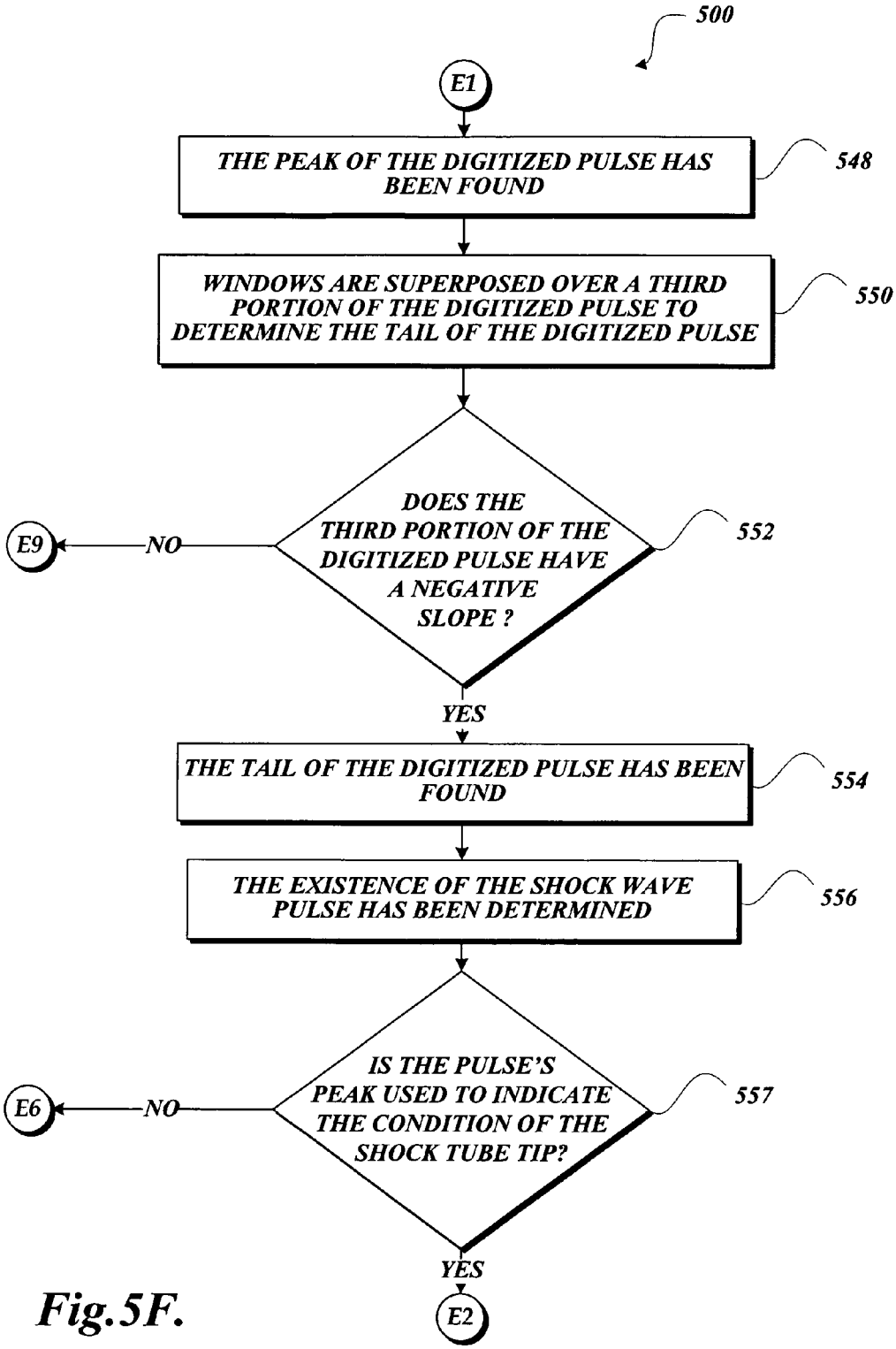
Figure 5G:
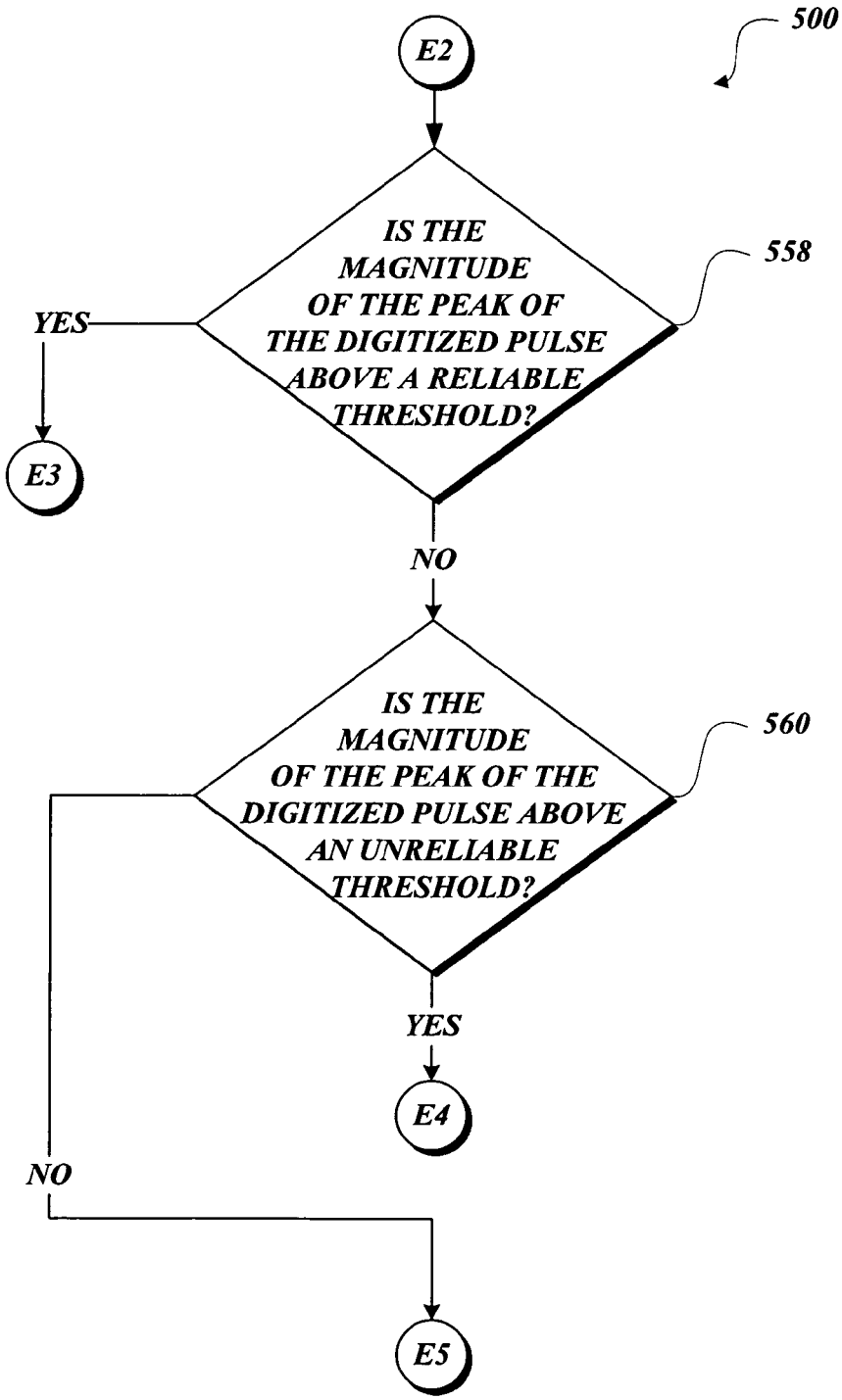
Figure 5H:
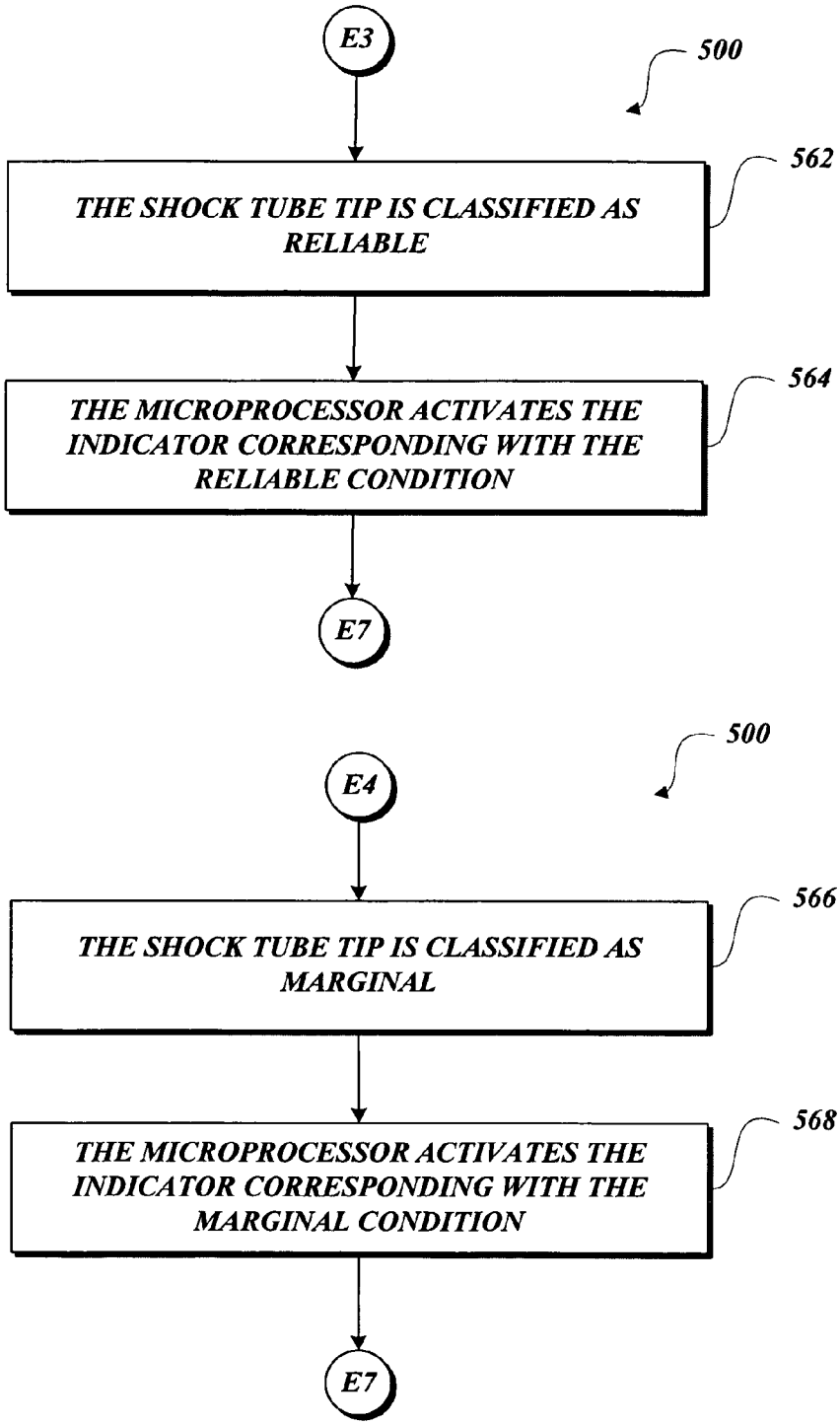
Figure 5I:
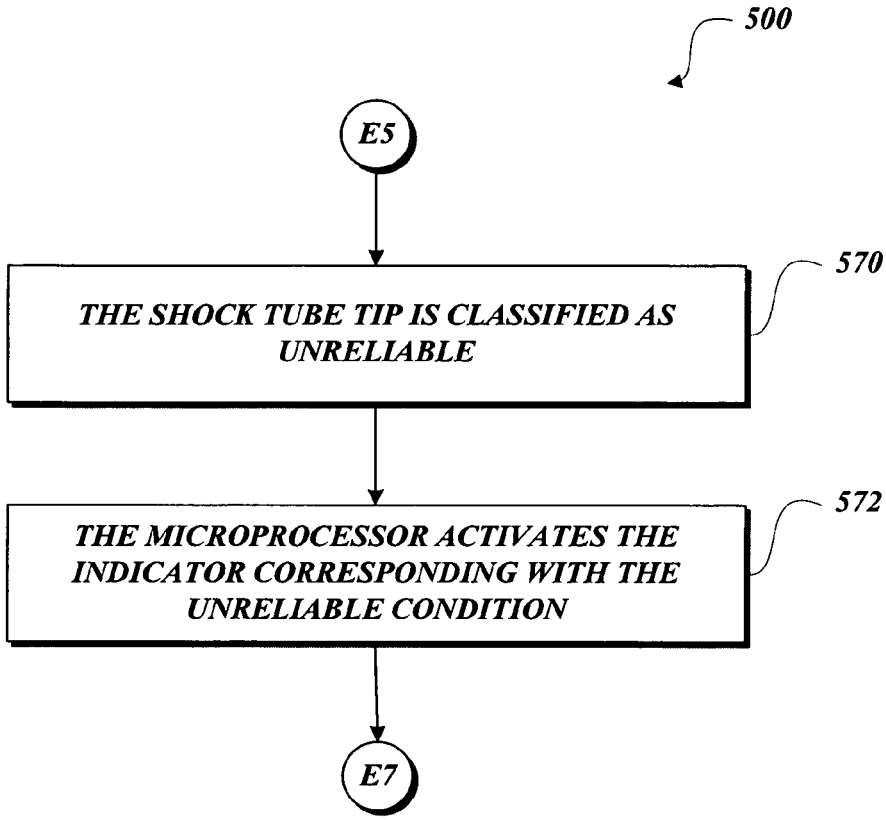
Figure 5J:
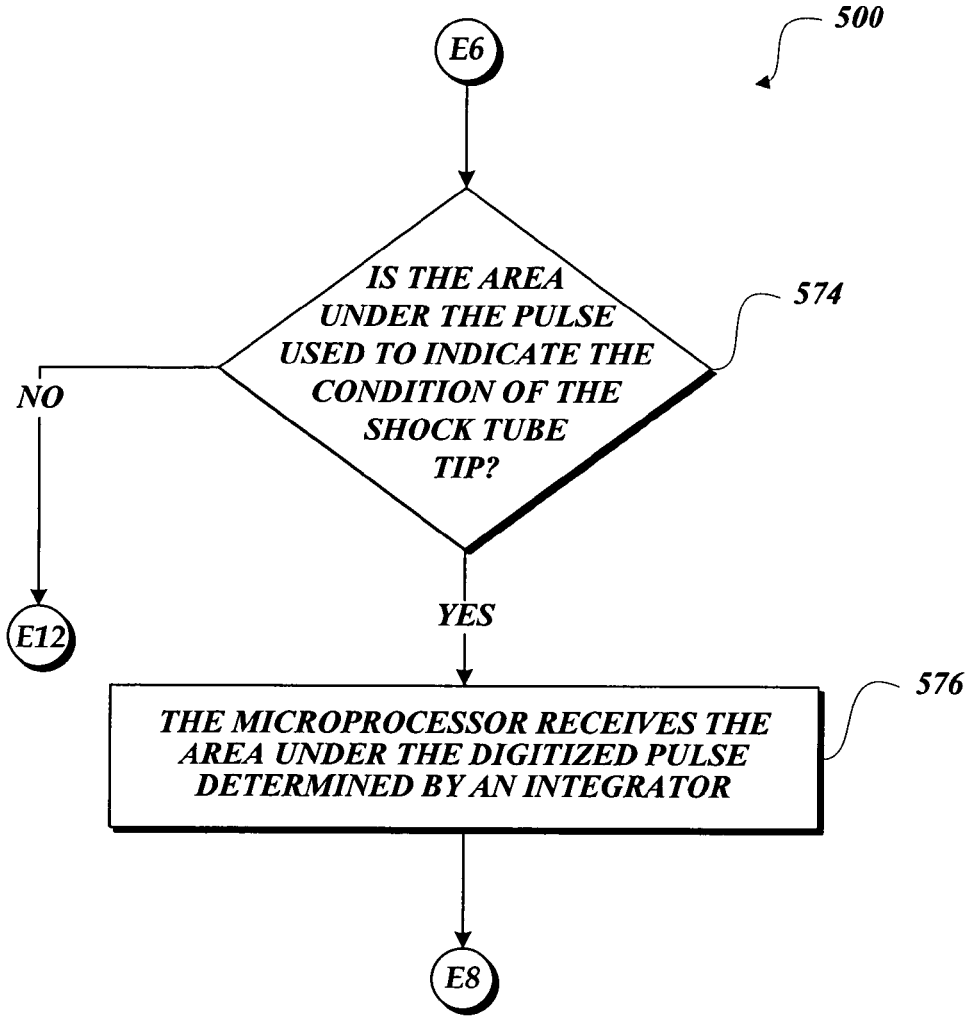
Figure 5K:
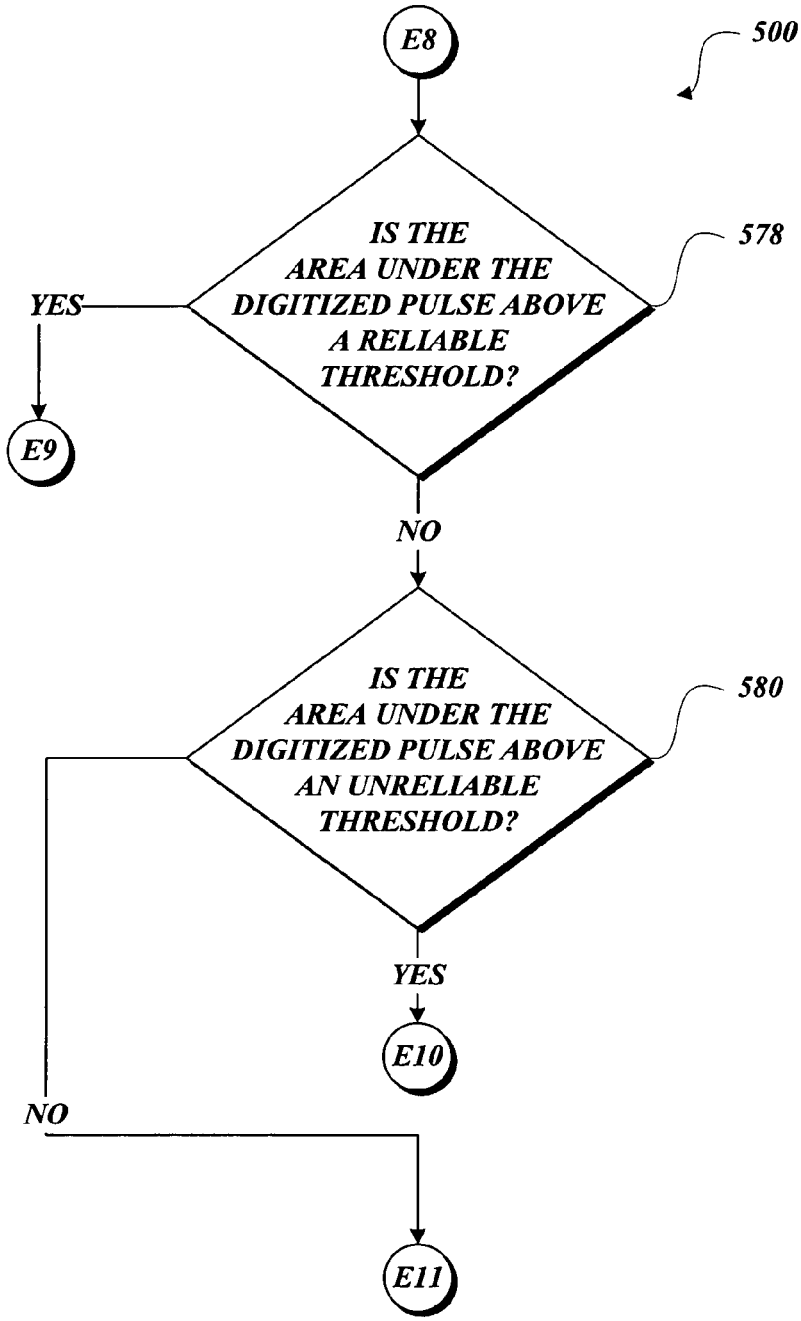
Figure 5L:
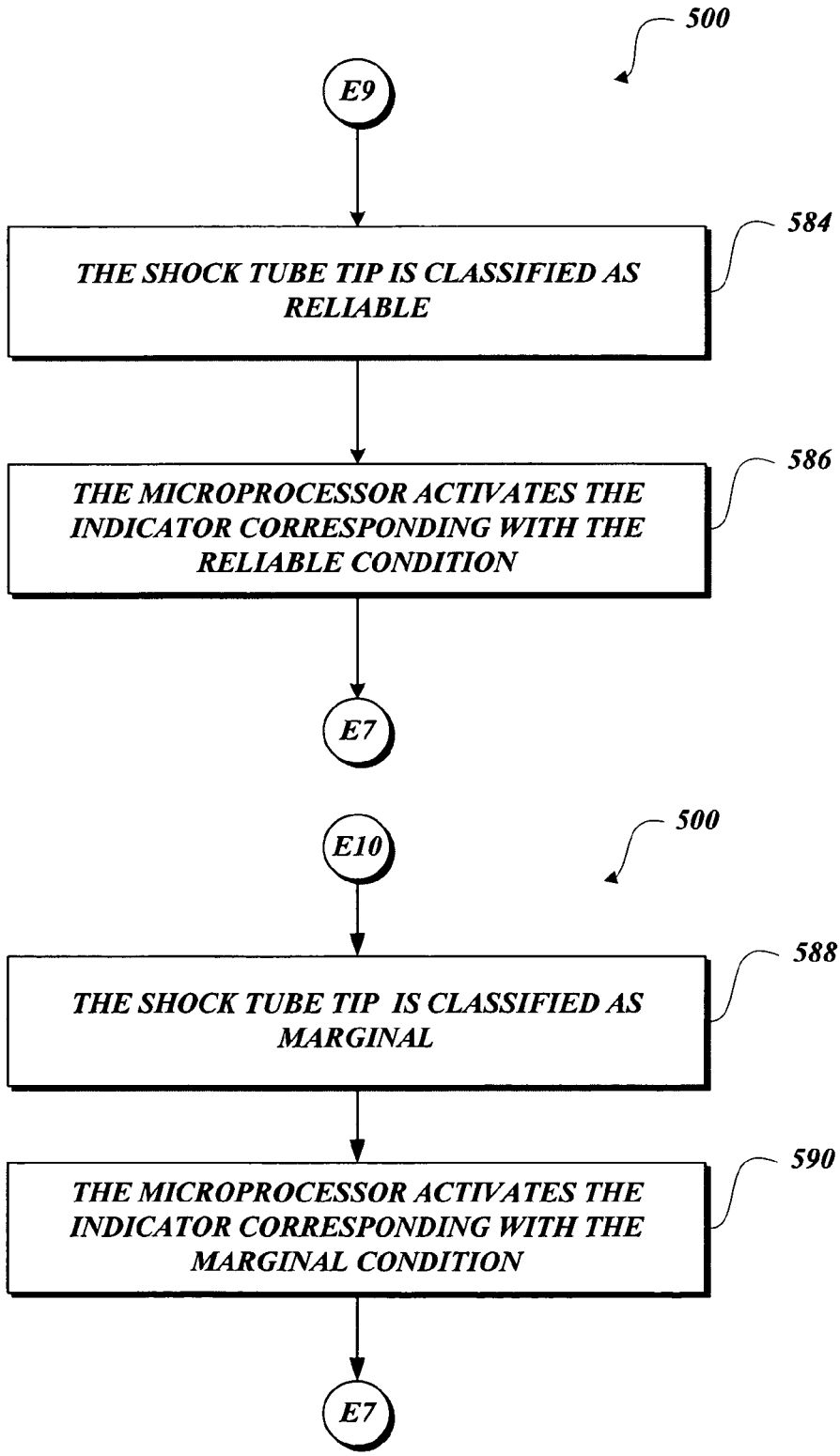
Figure 5M:
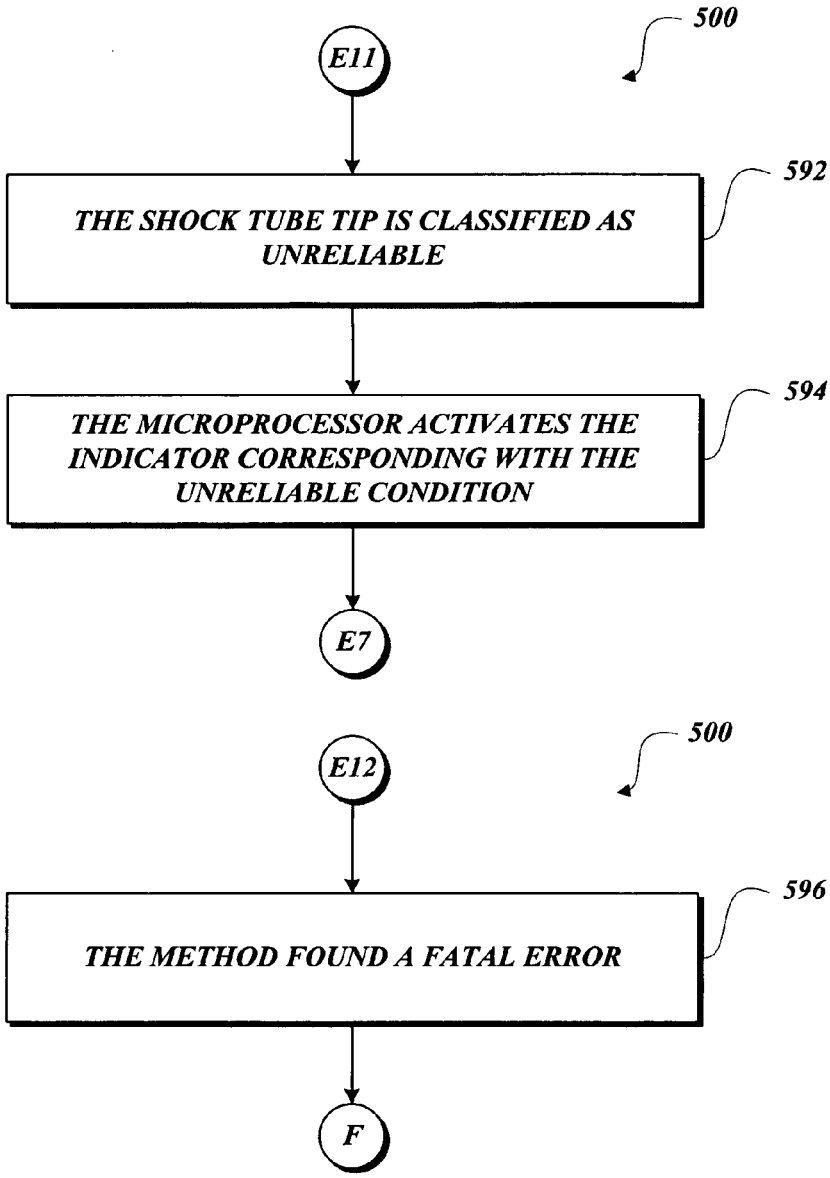
Figure 5N:
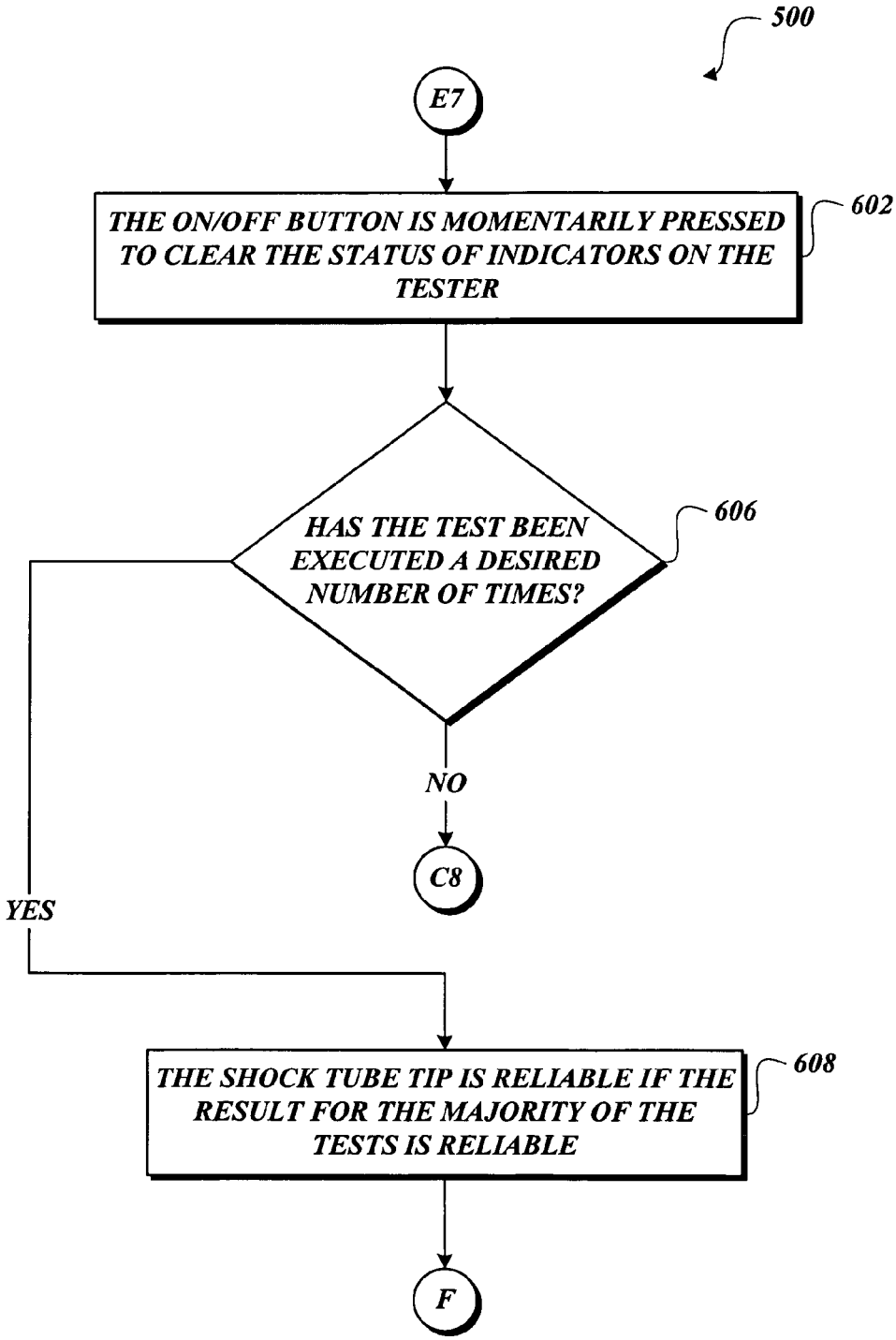

FIGS. 5A-5N illustrate a method 500 for testing a shock tube tip. From a start block (FIG. 5A), the method 500 proceeds to a set of method steps 502 defined between a continuation terminal ("terminal A") and an exit terminal ("terminal B"). The set of steps 502 prepares a remote firing system for testing the shock tube tip.

From terminal A (FIG. 5B), the method 500 proceeds to block 510 where the controller and the remote device in the remote firing system are powered on and self-testing for the controller and remote device are completed. At block 512, the shock tube tip under test is attached to the remote device. A shock tube connected to a primer and explosive charger is removed from the remote device. In an alternative embodiment of the present invention, the shock tube tip under test may be attached to a stand-alone non-electronic blasting machine. From block 512, the method 500 proceeds to terminal B. From terminal B (FIG. 5A), the method 500 proceeds to a set of method steps 504 defined between a continuation terminal ("terminal C") and an exit terminal ("terminal D"). The set of method steps 504 describes the insertion of the shock tube into a tester and is tested.

From terminal C (FIG. 5C), the method 500 proceeds to block 516 where the shock tube tip is connected into a test shock tube (which is coupled to a mechanical filter in the shock tube tip tester). The shock tube tip tester is powered on and completes its self-test. See block 518. In one embodiment of the present invention, the shock tube tip tester may be turned on by momentarily pressing the push-button switch (on/off switch) of the shock tube tip tester. The power-on LED on the indicator panel may be lit, indicating that the self-test of the shock tube tip tester is completed. At block 520, the controller sends arming and firing signals to the remote device. At block 522, the remote device receives the arming and firing signals via a wireless network, a wireless communication line, a radio communication line and the like. In response to the arming and firing signals, the remote device fires the shock tube tip. See block 524. In one embodiment of the present invention, the method 500 may trigger the stand-alone blasting machine to arm and fire the shock tube tip. At block 526, the shock tube tip produces a high-energy spark, creating a shock wave pulse. The method 500 continues to another continuation terminal ("terminal C1").

From terminal C1 (FIG. 5D), the method 500 proceeds to block 530 where the mechanical filter smoothes, averages, filters and/or delays the shock wave pulse. The pressure sensor senses the filtered shock wave pulse and provides corresponding voltage signals to the analog-to-digital converter (ADC). See block 532. Then, at block 534, the ADC converts the voltage signals to a digitized shock wave pulse (represented by digital information of the voltage signals). The method 500 proceeds to block 536 where the microprocessor receives the digitized shock wave pulse from the ADC. From block 536, the method 500 proceeds to terminal D. From terminal D (FIG. 5A), the method 500 proceeds to a set of method steps 508 defined between a continuation terminal ("terminal E") another continuation terminal ("terminal F"). The set of method steps 508 determines the condition of the shock tube tip.

The set of steps 508 also notify users of the determined condition of the shock tube tip. The existence of the digitized shock wave pulse is determined before proceeding to assess the condition of the shock tube tip. In an embodiment of the present invention, the existence of the digitized shock wave pulse is determined by detecting the head, the peak, and the tail in any order. However, if any combination of the head, peak, and tail is found, the existence of the shock wave pulse is likely. Otherwise, the microprocessor waits for a new digitized shock wave pulse from the ADC.

From terminal E (FIG. 5E), the method 500 proceeds to block 538 where one or more windows (time windows) are superposed over a first portion of the digitized shock wave pulse to determine the head of the digitized shock wave pulse. The method 500 watches for the head for a certain period of time. The method 500 enters decision block 540 where a test is performed to determine whether the portion of the digitized pulse has a positive slope.

If the answer to the test is NO (the portion of the digitized pulse does not have a positive slope), then the method 500 proceeds to a continuation terminal ("terminal C9") where it skips to block 536 (FIG. 5D) and repeats the previously discussed processing steps. If the answer to the test is YES (the portion of the digitized pulse has a positive slope), the head of the digitized shock wave pulse has been found. See block 542. At block 544, one or more windows are superposed over a second portion of the digitized shock wave pulse to determine the peak of the digitized shock wave pulse. The method 500 proceeds to decision block 546 where a test is performed to determine whether the second portion of the digitized pulse has both a positive slope and a negative slope. The method 500 watches for the peak for a certain period of time. If the answer to the test is YES (the portion of the digitized pulse has a positive and a negative slope), the method 500 proceeds to another continuation terminal ("terminal E1"). If the answer to the test is NO (the portion of the digitized pulse does not have a positive and a negative slope), the method 500 further proceeds to terminal C9 where it skips to block 536 (FIG. 5D) and repeats the previously discussed processing steps.

From terminal E1 (FIG. 5G), the method 500 proceeds to block 548 where the peak of the digitized shock wave pulse has been determined. At block 550, one or more windows (time windows) are superposed over a third portion of the digitized shock wave pulse to determine the tail of the digitized shock wave pulse. The method 500 watches for the tail for a certain period of time. The method 500 enters decision block 552 where a test is performed to determine whether the portion of the digitized pulse has a negative slope and an absence of excessive fluctuation.

If the answer to the test is NO (the portion of the digitized pulse does not have a negative slope), then the method 500 proceeds to terminal C9 where it skips to block 536 (FIG. 5D) and repeats the previously discussed processing steps. If the answer to the test is YES (the portion of the digitized pulse has a negative slope), the tail of the digitized shock wave pulse has been found. See block 544. The method 500 further proceeds to block 556 where the existence of the digitized shock wave pulse has been determined. The method 500 then enters decision block 557 where a test is performed to determine whether the peak of the digitized pulse is used to indicate the condition of the shock tube tip. If the answer to the test is YES (the peak of the digitized shock wave pulse is used to indicate the condition of the shock tube tip), the method 500 proceeds to another continuation terminal ("terminal E2"). If the answer is NO to the test at decision block 552 (the peak of the digitized shock wave pulse is not used to indicate the condition of the shock tube tip), the method 500 proceeds to another continuation terminal ("terminal E6").

In FIGS. 5G-5I, the method 500 compares the peak of the digitized shock wave pulse with various thresholds and determines the condition of the shock tube tip. As previously described, the peak of the digitized shock wave pulse may be used to infer the intensity of the spark produced by the shock tube tip (a condition of the shock tube tip).

From terminal E2 (FIG. 5G), the method 500 enters decision block 558 to determine whether the magnitude of the peak of the digitized shock wave pulse is above a reliable threshold. If the answer is YES (the magnitude of the peak of the digitized shock wave pulse is above a reliable threshold), the method 500 proceeds to another continuation terminal ("terminal E3"). If the answer is NO (the magnitude of the peak of the digitized shock wave pulse is not over a reliable threshold), the method 500 proceeds to decision block 560 where a test is performed to determine whether the magnitude of the peak of the digitized shock wave pulse is above an unreliable threshold. If the answer to the test is YES (the magnitude of the peak of the digitized shock wave is above the unreliable threshold but below the reliable threshold), the method 500 proceeds to another continuation terminal ("terminal E4"). If the answer to the test is NO (the magnitude of the peak of the digitized shock wave is below the unreliable threshold), the method 500 continues to another continuation terminal ("terminal E5").

From terminal E3 (FIG. 5H), the method 500 continues to block 562 where the shock tube tip is classified as reliable. At block 564, the microprocessor activates a corresponding indicator (for example, the green LED on the indicator panel), indicating the shock tube tip is in the reliable condition (reliable to use in the remote firing system). The method 500 further proceeds to another continuation terminal ("terminal E7").

From terminal E4 (FIG. 5H), the method 500 continues to block 566 where the shock tube tip is classified as marginally reliable. At block 568, the microprocessor activates a corresponding indicator (for example, the yellow LED on the indicator panel) indicating that the shock tube tip is in the marginally reliable condition (marginally reliable to use in the remote firing system). The method 500 further proceeds to terminal E7.

From terminal E5 (FIG. 5I), the method 500 continues to block 570 where the shock tube tip is classified as unreliable. At block 572, the microprocessor activates a corresponding indicator (for example, the red LED on the indicator panel) indicating that the shock tube tip is unreliable to use in the remote firing system. The method 500 proceeds to terminal E7.

In FIGS. 5J-5M, the method 500 calculates the area under the digitized shock wave pulse and determines the condition of the shock tube tip. As previously described, the area under the digitized shock wave pulse may be used to indicate the intensity of the spark produced by the shock tube tip (a condition of the shock tube tip).

From terminal E6 (FIG. 5J), the method 500 enters decision block 574 where a test is performed to determine whether the area under the digitized pulse is used to indicate the condition of the shock tube tip. If the answer to the test is YES (the area under the digitized pulse is used to indicate the condition of the shock tube tip), the method 500 proceeds to block 576 where the microprocessor queries for the area under the digitized pulse determined by an integrator, which could be implemented as a piece of hardware or software. The method 500 further proceeds to another continuation terminal ("terminal E8"). If the answer to the test is NO (neither the area under the digitized pulse, or the peak of the digitized pulse is used to indicate the condition of the shock tube tip), the method 500 proceeds to another continuation terminal ("terminal E12").

From terminal E8 (FIG. 5K), the method 500 enters decision box 578 to determine whether the area under the digitized shock wave pulse is above a reliable threshold. If the answer is YES (the area under the digitized shock wave pulse is above a reliable threshold), the method 500 proceeds to another continuation terminal ("terminal E9"). If the answer is NO (the area under the digitized shock wave pulse is not above a reliable threshold), the method 500 enters decision block 580 where a test is performed to determine whether the area under the digitized shock wave pulse is above an unreliable threshold. If the answer to the test is YES (the area under the digitized shock wave is above the unreliable threshold but below the reliable threshold), the method 500 proceeds to another continuation terminal ("terminal E10"). If the answer to the test is NO (the area under the digitized shock wave is below the unreliable threshold), the method 500 continues to another continuation terminal ("terminal E1").

From terminal E9 (FIG. 5L), the method 500 continues to block 584 where the shock tube tip is classified as reliable. At block 586, the microprocessor activates a corresponding indicator (for example the green LED on the indicator panel), indicating the shock tube tip is in the reliable condition (reliable to use in the remote firing system). The method 500 further proceeds to terminal E7.

From terminal E10 (FIG. 5L), the method 500 continues to block 588 where the shock tube tip is classified as marginally reliable. At block 590, the microprocessor activates a corresponding indicator (for example, the yellow LED on the indicator panel) indicating that the shock tube tip is in the marginally reliable condition (reliable to use in the remote firing system). The method 500 further proceeds to terminal E7.

From terminal E11 (FIG. 5M), the method 500 continues to block 592 where the shock tube tip is classified as unreliable. At block 594, the microprocessor activates a corresponding indicator (for example the red LED on the indicator panel), indicating that the shock tube tip is unreliable to use in the remote firing system. The method 500 proceeds to terminal E7. From terminal E12 (FIG. 5M), the method 500 continues to block 596 where a fatal error has been found. The method 500 proceeds to terminal F and terminates execution.

In a preferred embodiment of the present invention, the shock tube tip may be tested a desired number of times. In FIG. 5N, the method 500 proceeds to block 602 from terminal E7. At block 602, the on/off button of the shock tube tip tester is momentarily pressed again to clear the status of indicators. The tester is ready for another shock tube tip testing, if necessary. Preferably, the shock tube tip is tested multiple times, such as three times, so as to obtain statistically significant results. The method 500 further enters decision block 606 where a test is performed to determine whether the shock tube tip testing has been executed a desired number of times. If the answer to the test is NO (the shock tube tip has not been tested for the desired number of times), the method 500 proceeds to another continuation terminal ("terminal C8") for more tests. If the answer to the test is YES (the shock tube tip has been tested for the desired number of times), the method 500 continues to block 608 where the shock tube tip is determined to be reliable if the result of the majority of the tests is reliable. Other suitable ways to interpret the result for the test can be used.

In an embodiment of the present invention, the shock tube tip is determined to be reliable only if the result for each test indicates that the shock tube tip is in the reliable condition. Alternatively, additional desired number of tests is recommended if there is at least one result indicating that the shock tube tip is unreliable. In another embodiment of the present invention, if the results of tests vary, the shock tube tip tester may use the lowest value as the indication of the status of the shock tube tip. From block 608, the method 500 continues to terminal F and terminates execution.

While the preferred embodiment of the invention has been illustrated and described, it will be appreciated that various changes can be made therein without departing from the spirit and scope of the invention.

The invention claimed is:

1. A tester for determining an operating condition of a shock tube tip, comprising:

a mechanical filter suitable for filtering a shock wave pulse created by firing the shock tube tip;

a pressure sensor coupled to the mechanical filter for sensing the filtered shock wave pulse and outputting voltage signals;

an analog-to-digital converter for receiving the voltage signals from the pressure sensor and converting the voltage signals to a digitized shock wave pulse; and a microprocessor for classifying the operating condition of a shock tube tip based on a magnitude of a peak of the digitized shock wave pulse or an area under the digitized shock wave pulse.

2. The tester as described in claim 1, further comprising a status panel including a plurality of indicators for indicating whether the shock tube tip is reliable or not reliable.

3. The tester as described in claim 1, wherein the microprocessor determines the existence of the digitized shock wave pulse if a combination of a head, a peak, and a tail of the digitized shock wave pulse is detected.

4. The tester as described in claim 3, wherein the head of the digitized shock wave pulse is detected when a positive slope is found from a first portion of the digitized shock wave pulse.

5. The tester as described in claim 3, wherein the peak of the digitized shock wave pulse is detected when both a positive slope and a negative slope are found from a second portion of the digitized shock wave pulse.

6. The tester as described in claim 3, wherein the tail of the digitized shock wave pulse is detected when a negative slope is found from a third portion of the digitized shock wave pulse.

7. The tester as described in claim 1, further comprising an integrator for determining the area under the digitized shock wave pulse.

8. The tester as described in claim 1, further comprising a power supply capable of providing power so as to make the tester portable.

* * * * *